United States Patent [19]

Okabayashi et al.

[11] 3,980,281

[45] Sept. 14, 1976

[54] AGITATED VESSEL ACCESSORIES WITH VIBRATION SUPPRESSING STABILIZERS

[75] Inventors: Takashi Okabayashi; Satoru Mikuni, both of Kobe, Japan

[73] Assignee: Sybron Corporation, Rochester, N.Y.

[22] Filed: Oct. 22, 1974

[21] Appl. No.: 516,903

[30] Foreign Application Priority Data

Apr. 22, 1974 Japan ..... 49-45325

[52] U.S. Cl. ..... 259/107

[51] Int. Cl.[2] ..... B01F 7/16; B01F 7/18; B01F 7/20

[58] Field of Search ..... 259/1 R, DIG. 43, 99, 259/107

[56] References Cited

UNITED STATES PATENTS

| | | | |
|---|---|---|---|
| 757,375 | 4/1904 | West | 259/1 R |
| 763,769 | 6/1904 | Lavender | 259/1 R |
| 1,651,816 | 12/1927 | Goldman | 259/1 R |
| 1,777,646 | 10/1930 | Klein et al. | 259/1 R |
| 2,142,963 | 1/1939 | Dehuff | 259/1 R |
| 2,180,301 | 11/1939 | Saylor | 259/1 R X |
| 2,519,657 | 8/1950 | Hunter | 259/1 R |
| 3,414,240 | 12/1968 | Jung et al. | 259/107 |

*Primary Examiner*—Billy J. Wilhite
*Assistant Examiner*—Donald B. Massenberg
*Attorney, Agent, or Firm*—Theodore B. Roessel; James A. Rich

[57] ABSTRACT

Cantilevered accessories for vessels in which a liquid is agitated by a centrally located rotary agitator are provided with vibration suppressing stabilizer plates. The plates are mounted near the free end of the accessories, within the liquid in the vessel, and extend generally parallel to the direction of circulation of the liquid in the vessel.

2 Claims, 4 Drawing Figures

AGITATED VESSEL ACCESSORIES WITH VIBRATION SUPPRESSING STABILIZERS

BACKGROUND OF THE INVENTION

This invention relates to apparatus for suppressing vibrations in cantilevered accessories for agitated vessels.

It is common practice in the chemical, food and beverage processing industries, among others, to utilize vessels such as polymerizers, reactors, mixers and the like having various accessories extending into a liquid being agitated. Typically, the shaft of the agitator is located at the central vertical axis of the vessel and passes through bearings, seals and the like located at the top of the vessel. The shaft is rotated by a motor mounted outside the vessel. Blades extending from the shaft near the bottom of the vessel agitate the liquid.

In vessels equipped with this type of agitator, the liquid in the vessel tends to rotate or circulate with the agitator. This reduces the relative velocity between the agitator blades and the liquid and the effectiveness of the agitation. As a result, these vessels are frequently provided with baffles that extend into the liquid and hinder its circulation. Various other accessories such as blowing in tubes for introducing gases or liquid into the vessel, sheath tubes for thermometers or thermocouples, and sampling tubes also frequently project into the circulating liquid in the vessel. These accessories are usually cantilevered in the vessel, with one end mounted in the vessel wall and the free end projecting into the liquid. As the circulating liquid flows past these projecting accessories, eddy currents are generated on the down stream side of the accessories. These eddy currents produce periodic forces on the accessories that cause them to vibrate. These vibrations can loosen the accessories and/or cause structural damage.

SUMMARY OF THE INVENTION

It is an object of this invention to provide means for suppressing vibrations in cantilevered members that project into a liquid being circulated within the vessel by a centrally located rotary agitator. According to the invention, the cantilevered member is provided with at least one vibration suppressing stabilizer plate, located in the circulating liquid and extending substantially parallel to the direction of circulation.

DRAWINGS

DETAILED DESCRIPTION

Figure 1:
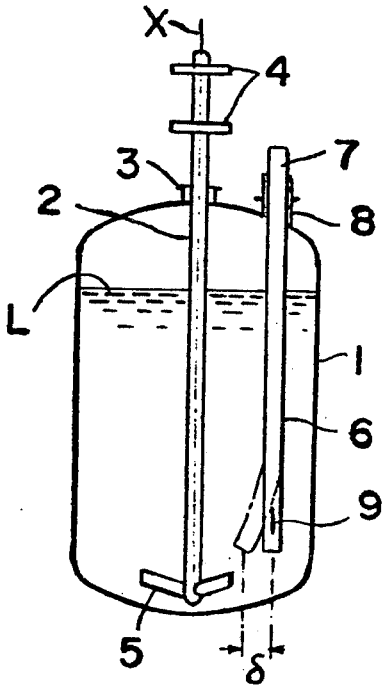
FIG. 1 is a diagrammatic elevation view of an agitated vessel containing an accessory embodying this invention.
Figure 3:
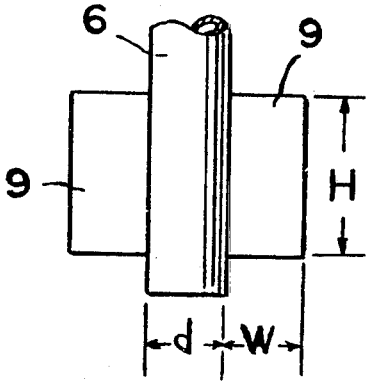
FIG. 3 is a detailed view of the accessory and stabilizer plates illustrated in FIGS. 1 and 2.
Figure 2:
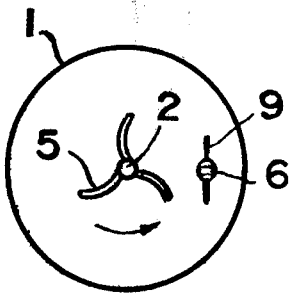
FIG. 2 is a plan view of the vessel illustrated in FIG. 1.

FIG. 1 illustrates a closed liquid containing vessel 1 having an agitator shaft 2 located at the central vertical axis $x$ of the vessel. The upper end of shaft 2 passes through a seal 3 in the top of the vessel and is supported by bearings 4 above the vessel. The shaft is rotated about the axis $x$ by a motor (not shown) outside the vessel. Three retrograded agitator blades 5 are provided at the free bottom end of the agitator shaft, which is in the liquid L in the vessel. As these agitator blades rotate, the liquid in the vessel tends to rotate around the central axis $x$ as illustrated by the arrow in FIG. 2.

A blowing in tube 6 extends into the liquid L in the vessel. The base 7 of tube 6 is mounted in a nozzle 8 at the top of vessel and the tube extends generally parallel to the central vertical axis $x$ at a position laterally displaced from this axis. Two vibration suppressing stabilizer plates 9 are installed near the free or bottom end of the tube. As may be seen in FIG. 2, these plates extend generally parallel to the direction of liquid circulation in the vessel, that is, at right angles to a radial line from the central axis $x$ to the projecting tube 6.

As the circulating liquid flows past the projecting blow in tube 6, it tends to induce violent vibrations in the tube. It has been found that these vibrations occur mainly in the radial direction to the central axis $x$. This may be ascribed to the eddy currents known as Karman vortices, generated alternately downstream of the projecting tube, which generate alternating periodic forces on the projecting tube in the radial direction. Since the stabilizer plates 9 have a maximum area in the vibrating direction, they effectively suppress these vibrations.

Figure 4:
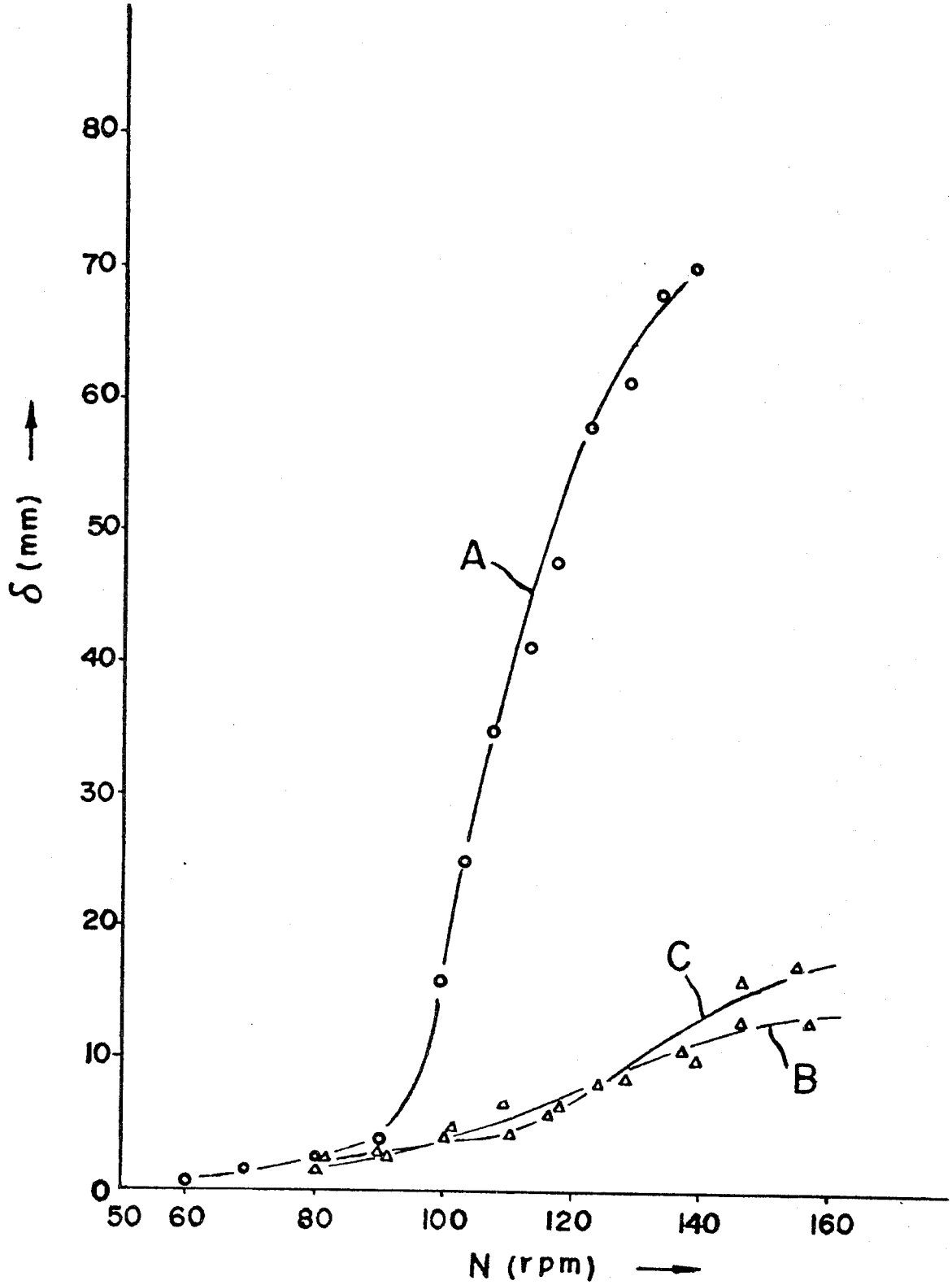
FIG. 4 is a graph of the results of experiments demonstrating the effectiveness of this invention.

The effectiveness of the present invention in suppressing these radial vibrations may be seen from FIG. 4, which is a graph of the amplitude $\delta$ of the deflections of the projecting tube 6 as a function of the rate of revolution of the agitator. The inner diameter of the vessel in this experiment with 1500 mm, the span of the agitator blades 5 was 1100 mm and the diameter d of the projecting blow in tube 6 was 76.3 mm. For one set of runs, the results of which are shown by curve A, the blow in tube was not equipped with stabilizers. For a second set of runs, shown in curve B, the blow in tube was furnished with two stabilizer plates 9, each of which had a width W of 1.0d and a height H of 2.5d. For a third set of runs, illustrated by curve C, the blow in tube was provided with two stabilizer plates, each of which had a width of 1.5d and a heighth of 2.5d.

As may be seen by the curves, violent vibrations were induced in the tube without the stabilizer plates when the speed of the agitator exceeded 100 rpm. However, when the tube was equipped with the stabilizer plates of this invention, the increase in the amplitude of vibration at higher speeds was relatively minor. Similar results have been obtained by measurements of bending stress at the base or anchored end of projecting bodies by strain gauges.

Thus, it may be seen that this invention provides a simple, effective means for suppressing vibrations and the strains they impose on cantilevered projecting members in agitated vessels. Of course, various modifications may be made to the embodiment disclosed above within the scope of this invention, which is defined by the following claims.

We claim:

1. In a liquid containing vessel having a centrally located rotary agitator that causes liquid to rotate about a central vertical axis of the vessel and an elongated member having a longitudinal axis extending generally parallel to said central axis at a positioned laterally displaced from said central axis and having a free end projecting into said liquid, the improvement comprising at least one vibration suppressing stabilizer plate having parallel and opposite flat surfaces extending from adjacent said free end of said elongated member substantially at right angles to a radial line from said central axis to said elongated member and positioned such that said flat surfaces are parallel to said elongated member longitudinal axis.

2. A vessel according to claim 1 wherein said elongated member is cylindrical and is provided with a pair of said vibration suppressing stabilizer plates extending from opposite sides of said member, the width of each of said stabilizer plates is between about 1.0 and about 1.5 times the diameter of the free end of said elongated member, and the heighth of each of said stabilizer plates is about 2.5 times the diameter of the free end of said elongated member.

* * * * *